US007958742B2

(12) United States Patent
Park et al.

(10) Patent No.: US 7,958,742 B2
(45) Date of Patent: Jun. 14, 2011

(54) DISPENSER AND REFRIGERATOR HAVING THE SAME

(75) Inventors: Yong Pil Park, Suwon-si (KR); Jong Su Jeon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 275 days.

(21) Appl. No.: 11/889,448

(22) Filed: Aug. 13, 2007

(65) Prior Publication Data

US 2008/0120987 A1 May 29, 2008

(30) Foreign Application Priority Data

Nov. 23, 2006 (KR) ..... 10-2006-0116398

(51) Int. Cl.
*F25D 3/00* (2006.01)

(52) U.S. Cl. ..... 62/389; 62/390

(58) Field of Classification Search ..... 62/389, 62/390

See application file for complete search history.

(56) References Cited

U.S. PATENT DOCUMENTS 4,209,999 A * 7/1980 Falk et al. ..... 62/344
5,474,213 A * 12/1995 Unger ..... 222/108
7,318,633 B2 * 1/2008 Shin et al. ..... 312/405

FOREIGN PATENT DOCUMENTS

KR 10-2005-0026740 3/2005

OTHER PUBLICATIONS

Chinese Office Action for corresponding Chinese application 2007101481704; mailed Aug. 22, 2008.

* cited by examiner

*Primary Examiner* — Cheryl J Tyler
*Assistant Examiner* — Lakiya Rogers
(74) *Attorney, Agent, or Firm* — Staas & Halsey LLP

(57) ABSTRACT

A refrigerator which includes a dispenser installed at a door so as to enable a user to extract water or ice without opening a door. The dispenser includes a case forming an extraction section which is a space through which the desired object is extracted, a push button installed to the case and causing the desired object to be extracted by push operation, a cover having an opening formed by cutting out part thereof and pivotably installed to the case so as to open and close the extraction section, and a lever hinged to the cover so as to open and close the opening and pushing the push button while the opening is open. Therefore, a front appearance of the refrigerator is beautifully maintained. Further, the refrigerator prevents foreign materials such as dust from entering extraction ports through which the desired objects are extracted.

20 Claims, 6 Drawing Sheets

Fig. 1 – PRIOR ART

DISPENSER AND REFRIGERATOR HAVING THE SAME

CROSS-REFERENCE TO RELATED APPLICATIONS

This application claims the benefit of Korean Patent Application No. 10-2006-0116398, filed on Nov. 23, 2006, in the Korean Intellectual Property Office, the disclosure of which is incorporated herein by reference.

BACKGROUND

1. Field

The present invention relates to a refrigerator. More particularly, a refrigerator having a dispenser installed at a door so as to enable a user to extract water or ice without opening a door.

2. Description of the Related Art

A conventional refrigerator is an appliance that allows cold air generated by a refrigerating cycle to be supplied to a storage chamber, and thereby to maintain freshness of various foodstuffs for a long time. The conventional refrigerator includes a main body that forms a storage chamber in which foodstuffs are stored, and at least one door that is pivotably installed to the main body and opens and closes the storage chamber. Recently, the door of the refrigerator has been provided with a dispenser, thereby enabling a user to conveniently extract water or ice without opening the door, as well as preventing cold air in the storage chamber from being lost due to frequent opening and closing of the door.

FIG. 1 is a perspective view illustrating a conventional refrigerator having a dispenser. As illustrated in FIG. 1, the conventional refrigerator is constructed such that a door 2 for a refrigerating chamber and a door 3 for a freezing chamber are pivotably installed to a main body 1 so as to allow the refrigerating chamber and the freezing chamber to be opened and closed.

The refrigerating-chamber door 2 is provided with a home bar 4 so as to allow a water bottle, a beverage bottle, etc. to be taken out, and the freezing-chamber door 3 is provided with a dispenser 5 so as to water or ice to be extracted. The dispenser 5 includes an extracting section 6 that is open at the front thereof and allows a container for water or ice to be accessed, and an operating lever 7 that is installed to the extracting section 6 and operates to allow the water or ice to be extracted.

However, the conventional refrigerator fails to give fine appearance to the front thereof due to the open front of the dispenser 5 and the exposure of the operating lever 7. Further, because the front of the dispenser 5 is always open, foreign materials such as dust generated indoors can be introduced into the inlet port through which the water or ice is extracted, which is bad from the sanitary viewpoint.

SUMMARY

Accordingly, it is an aspect of the present invention to provide a dispenser and refrigerator having the same, capable of improving a front appearance of the refrigerator as well as preventing foreign materials such as dust from entering an extraction port through which water or ice is extracted.

Additional aspects and/or advantages will be set forth in part in the description which follows and, in part, will be apparent from the description, or may be learned by practice of the invention.

The foregoing and/or other aspects of the present invention are achieved by providing a refrigerator having a dispenser so as to enable a user to extract a desired object such as water or ice without opening a door, wherein the dispenser includes a case forming an extraction section which is a space through which the desired object is extracted, a push button installed to the case and causing the desired object to be extracted by push operation, a cover having an opening formed by cutting out part thereof and pivotably installed to the case so as to open and close the extraction section, and a lever hinged to the cover so as to open and close the opening and pushing the push button while the opening is open.

According to an aspect of the present invention, the lever includes hinge shafts formed on a lower side so as to be able to rotate about the cover, and an elastic unit causing the lever to return to an original state when force applied to the lever in a pushed state is removed Further, according to an aspect of the present invention, the lever further includes a stopper hooked on the cover so as to be able to be pivoted only toward the extraction section.

According to an aspect of the present invention, the refrigerator further includes a hooking unit which allows the cover to be coupled with and decoupled from the door whenever the user pushes the cover.

According to an aspect of the present invention, the case includes a water tray for collecting the desired object which is not contained in a container at a lower portion of the extraction section.

Further, according to an aspect of the present invention, the extraction section includes at least one extraction port through which the desired object is extracted.

Also, according to an aspect of the present invention, the cover includes a flat plate such that a front surface thereof forms the same plane as a front surface of the door when the cover closes the extraction section.

It is another aspect of the present invention to provide a dispenser for a refrigerator enabling a user to extract a desired object such as water or ice without opening a door. The dispenser includes a case forming an extraction section which is a space through which the desired object is extracted, a push button installed to the case and causing the desired object to be extracted by push operation, a cover having an opening formed by cutting out part thereof and pivotably installed to the case so as to open and close the extraction section, and a lever hinged to the cover so as to open and close the opening and pushing the push button while the opening is open.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
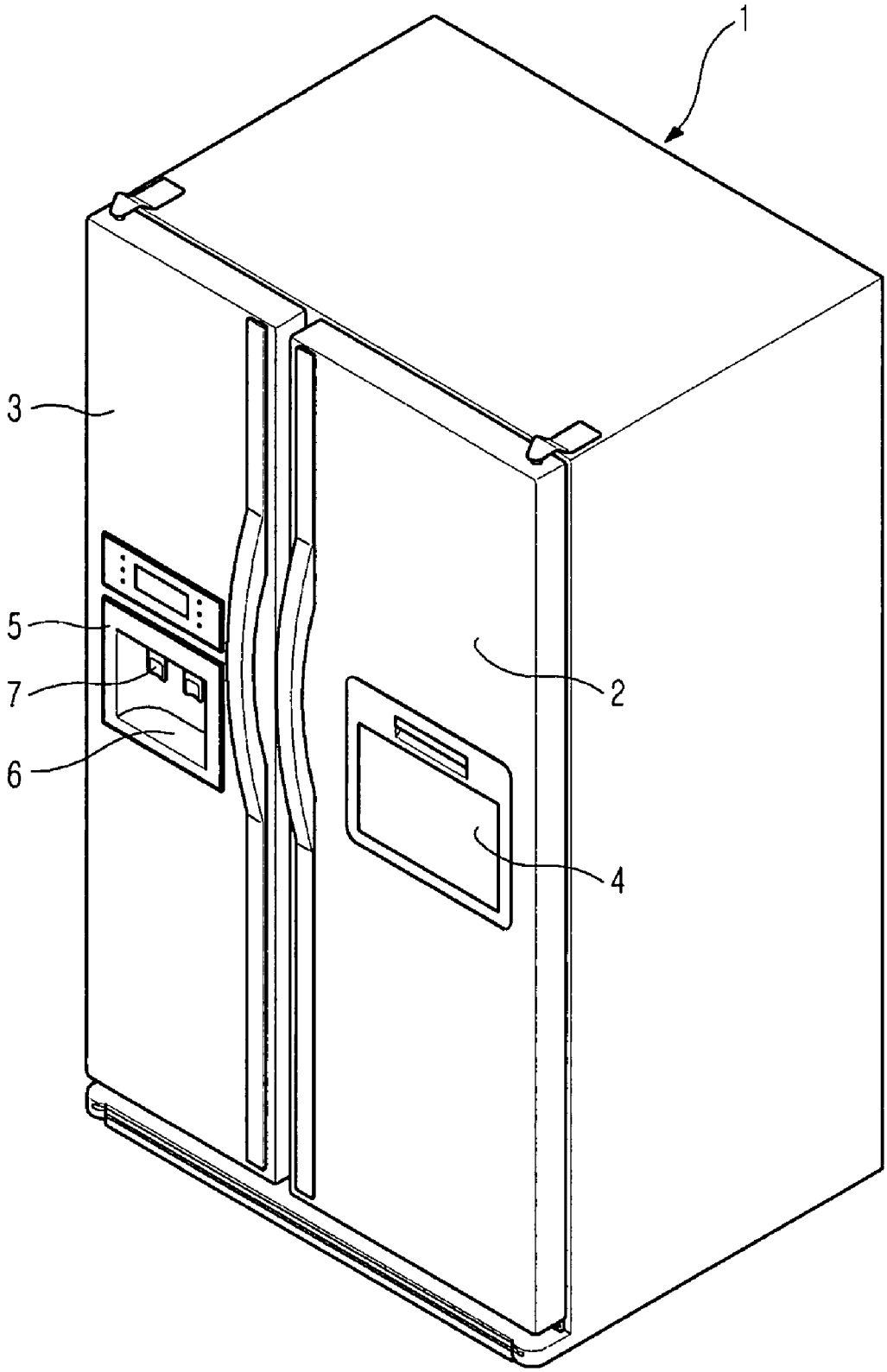
FIG. 1 is a perspective view illustrating a conventional refrigerator having a dispenser.

Reference will now be made in detail to the embodiments, examples of which are illustrated in the accompanying drawings, wherein like reference numerals refer to the like elements throughout. The embodiments of the present invention are described below to explain the present invention by referring to the figures.

Figure 2:
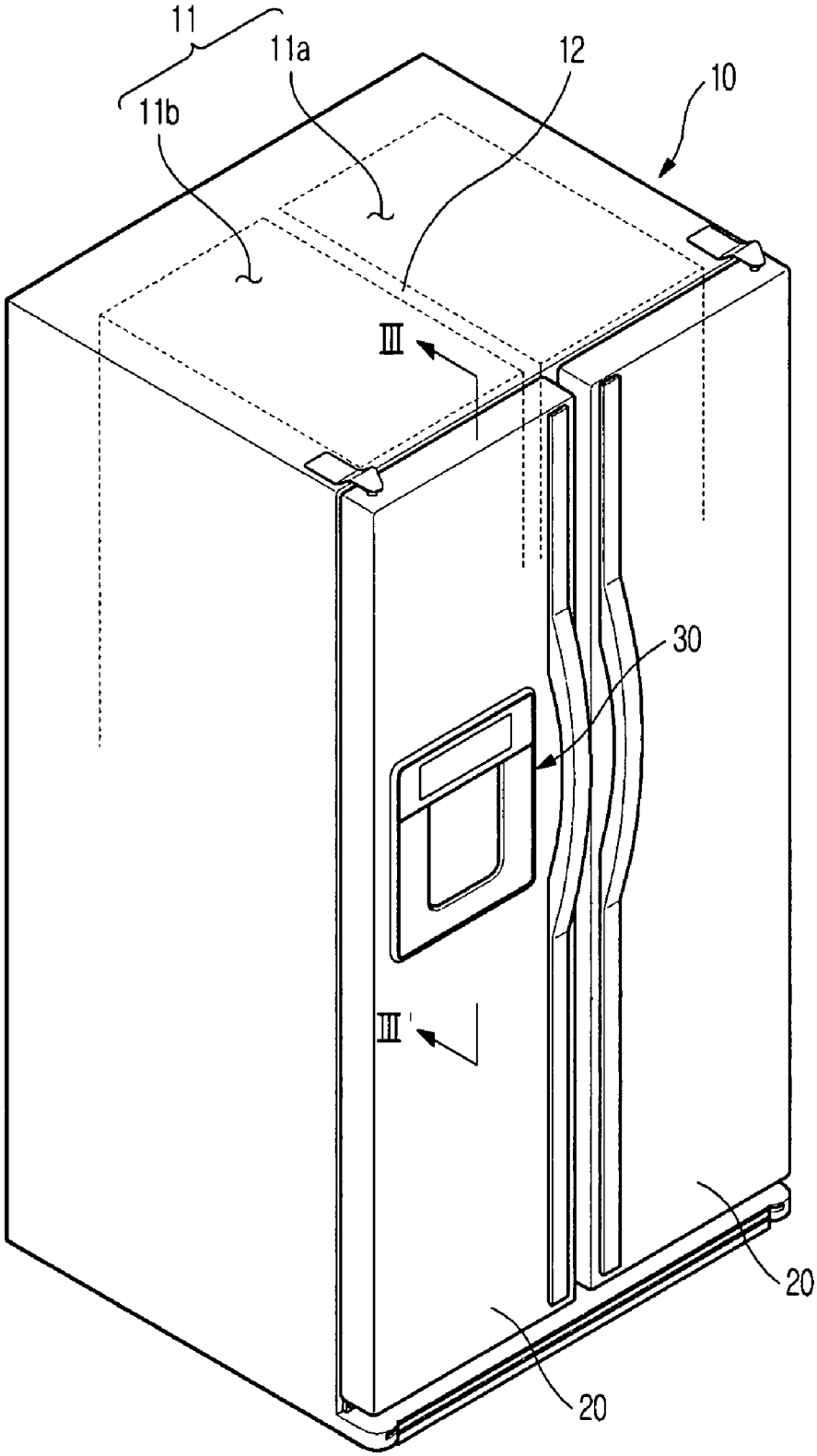
FIG. 2 is a perspective view illustrating the appearance of a refrigerator according to an embodiment of the present invention.
Figure 3:
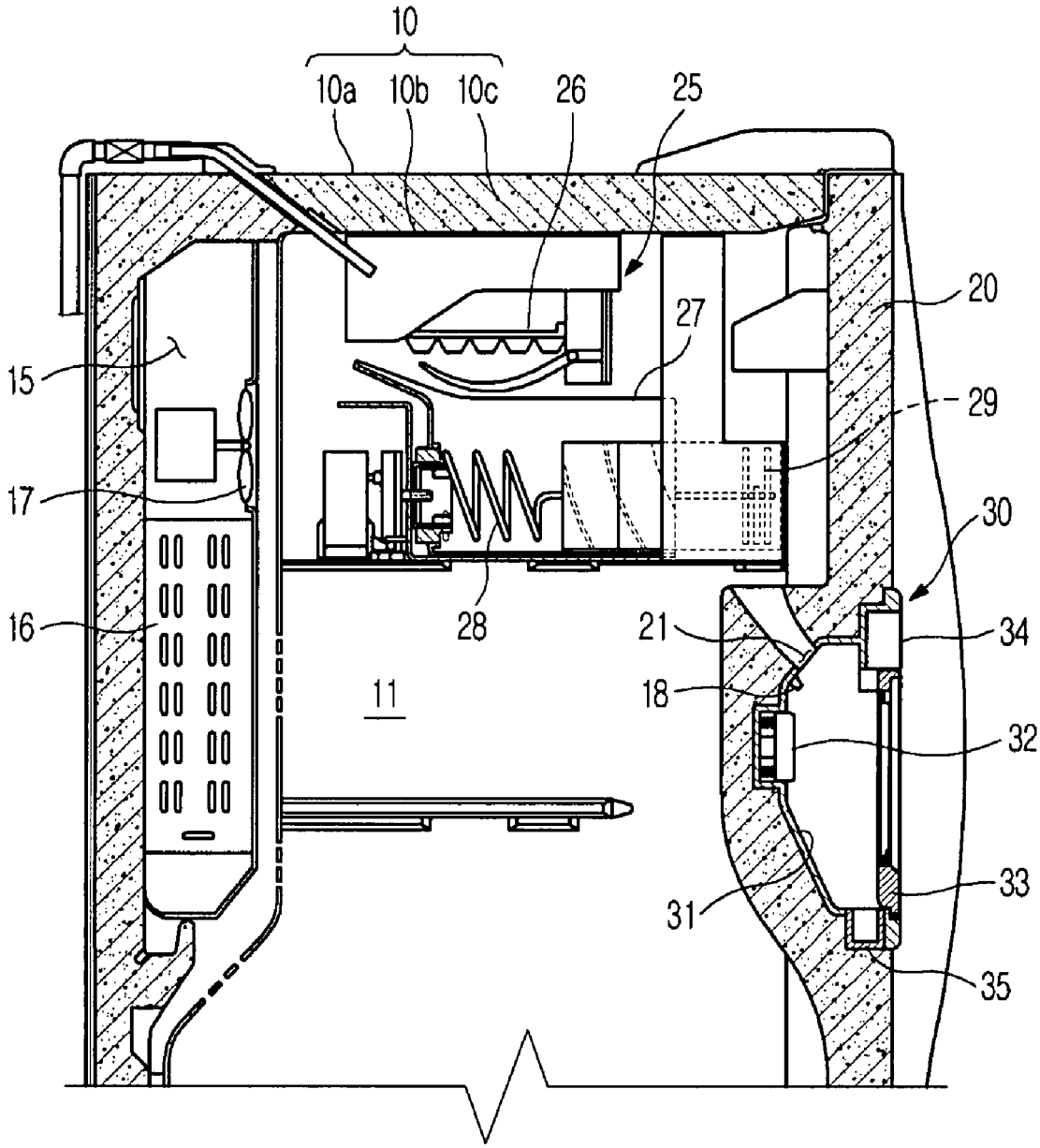
FIG. 3 is a sectional view taken along line III-III' of FIG. 2.
Figure 4:
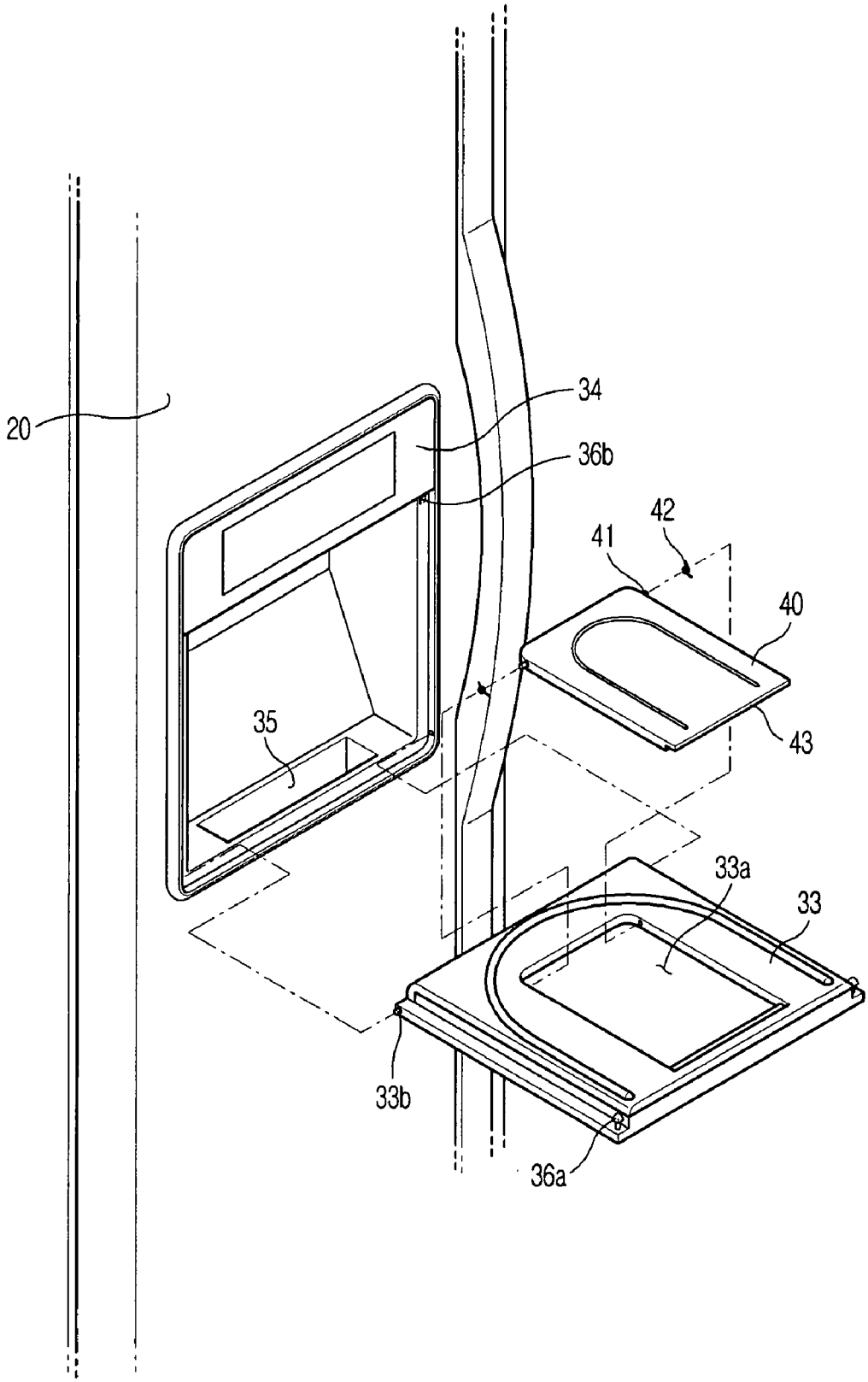
FIG. 4 is an enlarged perspective view illustrating the dispenser disassembled from the refrigerator of FIG. 2 according to an embodiment of the present invention.

FIG. 2 is a perspective view illustrating the appearance of a refrigerator according to an embodiment of the present invention. FIG. 3 is a sectional view taken along line III-III' of FIG. 2. FIG. 4 is a perspective view illustrating only the dispenser of FIG. 2, wherein a cover is disassembled from a door.

As illustrated in FIGS. 2 and 3, the refrigerator, according to an embodiment of the present invention, comprises a main body 10 which includes a storage chamber 11 for storing food, and a pair of doors 20 that are pivotably installed to the main body 10 so as to open and close the storage chamber 11. The main body 10 comprises an outer cabinet 10*a* forming an outer surface thereof, and an inner cabinet 10*b* spaced apart from the outer cabinet 10*a* at a predetermined interval and forming the storage chamber 11 thereinside. A heat insulating material 10*c* to prevent cold air from being lost is formed between the outer cabinet 10*a* and the inner cabinet 10*b*.

The storage chamber 11 is divided left and right into a refrigerating chamber 11*a* and a freezing chamber 11*b* by an intermediate partition 12, wherein the refrigerating chamber 11*a* cools and stores food on the right side, and the freezing chamber 11*b* freezes and stores food on the left side. The storage chamber 11 is provided with a cold air generating chamber 15, which generates cold air to be supplied to the storage chamber 11, at the rear thereof. The cold air generating chamber 15 comprises an evaporator 16, which exchanges heat with surrounding air and thereby generating cold air. A blowing fan 17 for supplying the generated cold air to the storage chamber 11 is installed around the evaporator 16.

Further, the door 20 comprises a dispenser 30 on the front surface thereof such that a user can extract a desired object such as water or ice without opening the door 20. Although not illustrated in the figure, the main body 10 is provided with a water vessel in which water is stored, and a water supply pipe that guides the water from the water vessel to the dispenser 30. The water supply pipe is provided, at one end thereof, with a water extraction port 18, through which the cold water stored in the water vessel is extracted.

Further, the freezing chamber 11*b* is provided therein with an ice supply mechanism 25 for supplying ice to the dispenser 30. The ice supply mechanism 25 comprises an ice making unit 26 which makes ice cubes, an ice storage vessel 27 that is disposed below the ice making unit 26 and stores the ice cubes made by the ice making unit 26, a transfer unit 28 transfers the ice cubes stored in the ice storage vessel 27, and a cracking unit 29 cracks the ice cubes transferred by the transfer unit 28 and makes chips of ice. In this manner, in order to extract the ice cubes made by the ice supply mechanism 25 to the dispenser 30, the door 20 comprises an ice extraction port 21 to extract the ice cubes.

As illustrated in FIGS. 2, 3 and 4, the dispenser 30 according to an embodiment of the present invention, comprises a case 31 that forms an extraction section 31*a* which is a space for extracting a desired object such as water or ice, a push button 32 (i.e., key unit) which is installed on a rear surface of the case 31 and operates a device which extracts the desired object such as water or ice, and a cover 33 which is pivotably installed to the case 31 so as to be able to open and close the extraction section 31*a*.

The case 31 comprises the water and ice extraction ports 18 and 21, through which the desired object is extracted, at the upper rear thereof, and a display panel 34, which displays the operated state of the dispenser, at the upper front thereof. Further, the case 31 comprises a water tray 35 to collect a part of the desired object which is extracted through the water and ice extraction ports 18 and 21 but is not contained in a container.

The cover 33 is made of a flat plate, for example, such that the front surface of the cover 33 forms the same plane as the front surface of the door 20 when the extraction section 31*a* is closed. The cover 33 comprises an opening 33*a* at a central portion thereof, formed by cutting out part thereof so as to allow a container such as a cup to pass through the opening 33*a*.

The cover 33 comprises hinge shafts 33*b* at a lower portion thereof, such that the cover 33 is pivotably coupled with the case 31. Further, the cover 33 comprises a hooking unit 36 at an upper portion thereof, such that the cover 33 is coupled with and decoupled from the door 20 whenever the user pushes the cover 33.

The hooking unit 36 comprises hooks 36*a* installed to the cover 33, and hooking recesses 36*b* installed to the case 31 and receiving and separating the hooks 36*a*. This hooking unit 36 is broadly used, and so a description thereof will be omitted.

In this manner, due to the cover 33 opening and closing the extraction section 31*a*, the front appearance of the refrigerator is more beautiful, and the refrigerator prevents foreign materials such as dust from entering the extraction ports 18 and 21 through which the desired objects are extracted.

The dispenser 30 of the refrigerator according to an embodiment of the present invention comprises a lever 40 such that the user pushes the push button 32 to be able to extract the desired object such as water or ice although the cover 33 does not open the extraction section 31*a*.

The lever 40 is adapted to open and close the extraction section 31*a* together with the cover 33, as well as to open and close the opening 33*a* of the cover 33. The lever 40 comprises hinge shafts 41 on opposite side of a lower end thereof, so that the lever 40 can be pivoted backwards to push the push button 32 when the user grasps the container such as a cup to push the lever 40. Elastic springs 42 are fitted around the hinge shafts 41 such that the lever 40 returns to an original state when the user releases force applied to the lever 40.

The lever 40 comprises a stepped stopper 43 at an upper end thereof. The elastic force of the elastic springs 42 is exerted in a direction where the lever 40 is supported on the cover 33. Therefore, the lever 40 can be pivoted only toward the extraction section 31*a*, and is pressed in the direction supported on the cover 33. When the force applied to the lever 40 is removed, the lever 40 is unified with the cover 33 by means of the elastic force of the elastic springs 42.

Figure 5:
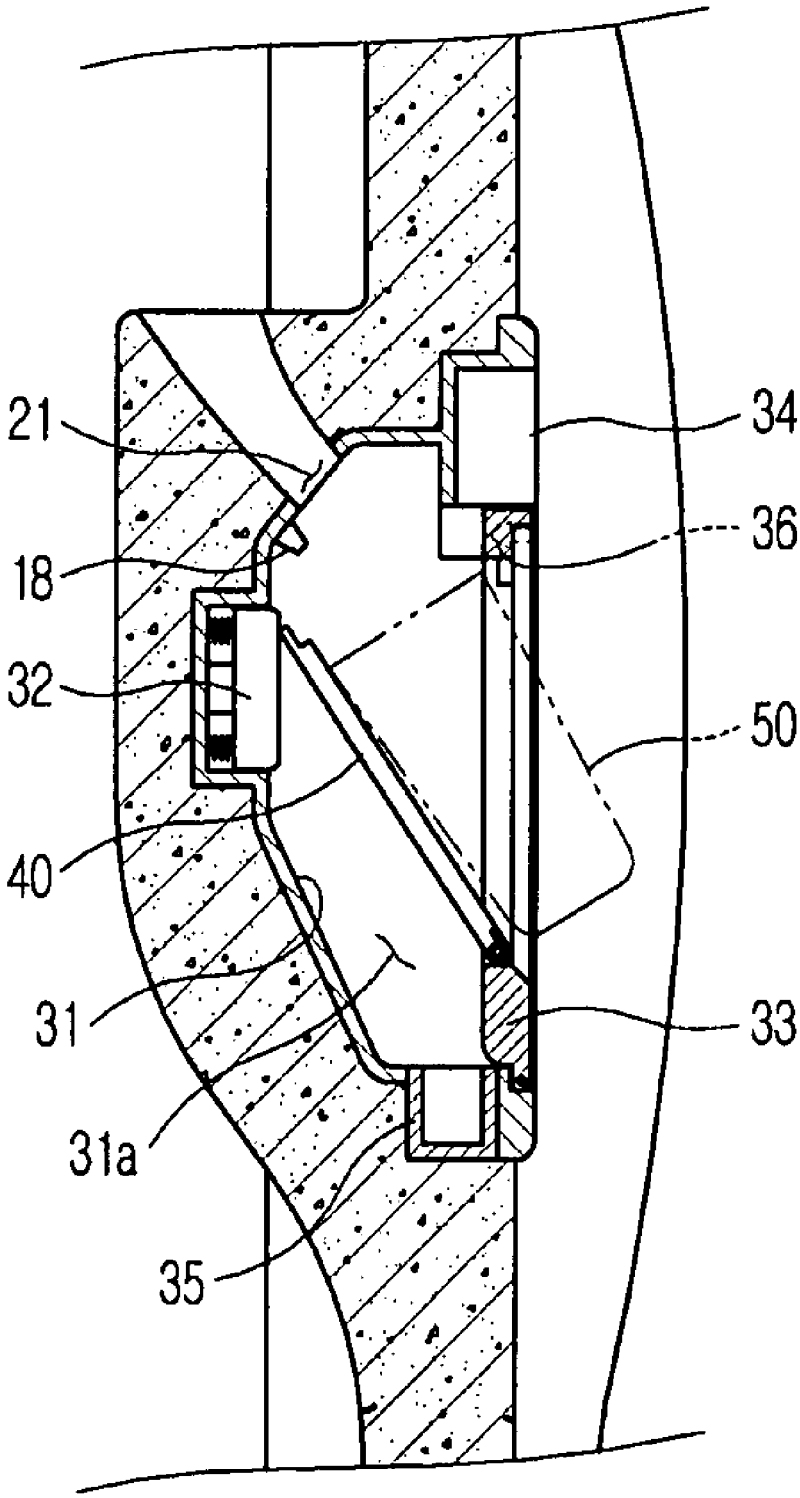
FIGS. 5 and 6 illustrate the operation of a dispenser according to an embodiment of the present invention.
Figure 6:
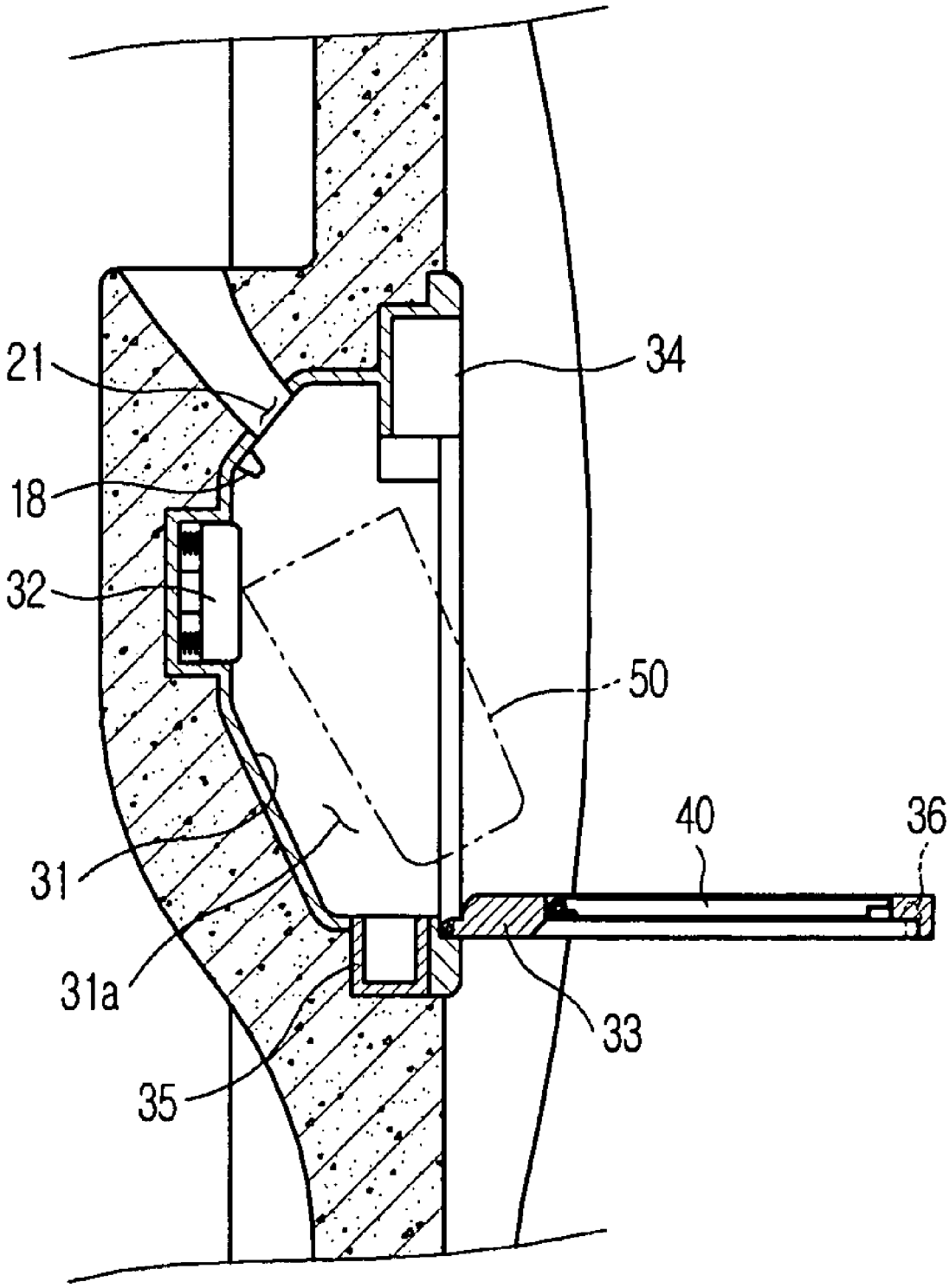

FIGS. 5 and 6 illustrate the operation of a dispenser according to an embodiment of the present invention.

When the user wants to extract a desired object using a container 50 that is smaller than the opening 33*a*, the user pushes the lever 40 in the state in which the cover 33 closes the extraction section 31*a* as illustrated in FIG. 5. Therefore, the lever 40 is rotated about the hinge shafts 41 toward the extraction section 31*a*. Thus, the upper end of the lever 40 rotated about the hinge shafts 41 pushes the push button 32, and then the desired object such as water or ice is extracted and contained into the container 50.

After the desired object is contained into the container 50 at a desired amount, the user removes the force applied to the lever 40. Thus, the lever 40 returns to its original state by rotating about the hinge shafts 41 by means of the elastic force of the elastic springs 42, thereby closing the opening 33*a*.

According to an embodiment of the present invention, when the user wants to extract the desired object using the container 50 that is larger than the opening 33*a*, the container 50 cannot pass through the opening 33*a* of the cover 33.

At this time, when the user pushes the upper portion of the cover 33, the hooks 36*a* of the hooking unit 36 escape from the hooking recesses 36*b* as illustrated in FIG. 6, and the cover 33 is rotated about the hinge shafts 33*b*, thereby opening the extraction section 31*a*.

In this manner, when the cover 33 opens the extraction section 31*a*, and thus the rear surface of the cover 33 is in an approximately horizontal state, the cover 33 can be used as a support table on which the container such as a cup is placed.

When the user directly pushes the push button 32 using the container 50 in the state in which the cover 33 has opened the extraction section 31*a*, the desired object is extracted through the extraction port 18 or 21, and is contained into the container 50.

After the user extracts the desired object, the user fixes the upper portion of the cover 33 to the case 31 using the hooking unit 36 installed to the upper portion of the cover 33, thereby closing the extraction section 31*a*. Thus, the front appearance of the refrigerator is beautifully maintained, and the refrigerator prevents foreign materials such as dust from entering the extraction ports 18 and 21 through which the desired objects are extracted.

As described in detail above, according to the dispenser and the refrigerator having the same, various switches installed to the extraction section can be covered, and thus the front appearance of the refrigerator is beautifully maintained.

Further, according to an embodiment of the present invention, the dispenser prevents the foreign materials such as dust from entering the extraction ports through which the desired objects are extracted.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator having a door, the refrigerator comprising:

a dispenser to enable a user to extract water or ice without opening the door, the dispenser comprises:

a case forming an extraction section which is a space through which the water or ice is extracted;

a push button installed to the case and causing the water or ice to be extracted by push operation;

a cover comprising an opening defined therethrough and pivotably installed to the case so as to open and close the extraction section; and a lever hinged to the cover opening and closing the opening by rotating a portion of the cover with respect to the opening and pushing the push button while the opening is open.

2. The refrigerator as claimed in claim 1, wherein the lever comprises:

hinge shafts formed on a lower side so as to be able to rotate about the cover; and an elastic unit causing the lever to return to an original state when force applied to the lever in a pushed state is removed.

3. The refrigerator as claimed in claim 2, wherein the lever further comprises a stopper hooked on the cover so as to be able to be pivoted only toward the extraction section.

4. The refrigerator as claimed in claim 1, further comprising a hooking unit which allows the cover to be coupled with and decoupled from the door whenever the user pushes the cover.

5. The refrigerator as claimed in claim 1, wherein the case comprises a water tray to collect the water or ice which is not contained in a container, at a lower portion of the extraction section.

6. The refrigerator as claimed in claim 1, wherein the extraction section comprises at least one extraction port through which the water or ice is extracted.

7. The refrigerator as claimed in claim 1, wherein the cover comprises a flat plate such that a front surface thereof forms the same plane as a front surface of the door when the cover closes the extraction section.

8. A dispenser for a refrigerator enabling a user to extract water or ice without opening a door, the dispenser comprising:

a case forming an extraction section which is a space through which the water or ice is extracted;

a push button installed to the case and causing the water or ice to be extracted by push operation;

a cover having an opening defined therethrough and pivotably installed to the case so as to open and close the extraction section; and a lever hinged to the cover opening and closing the opening by rotating a portion of the cover with respect to the opening and pushing the push button while the opening is open.

9. A refrigerator comprising:

a dispenser installed in a door of the refrigerator to dispense water or ice to an exterior of the door, the dispenser comprising:

a case forming an extraction section through which the water or ice is extracted;

a key unit causing the water or ice to be extracted by operation based upon a user's preference;

a cover comprising an opening defined through a center thereof, pivotably installed to the case to open and close the extraction section; and a lever hinged to the cover to open and close the extraction section together with the cover and opening and closing the opening by rotating a portion of the cover with respect to the opening and to contact with the key unit when the opening is in an open position.

10. The refrigerator according to claim 9, wherein the case comprises:

water and ice extraction ports through which water and ice are extracted, at an upper rear thereof; and a display which displays an operating stated of the dispenser.

11. The refrigerator according to claim 10, wherein the case further comprises a water tray to collect excess water or ice which is extracted through the water or ice extraction ports.

12. The refrigerator according to claim 11, wherein the cover is made of a flat plate such that a front surface of the cover forms the same plane as a front surface of the door when the extraction section is closed.

13. The refrigerator according to claim 12, wherein the opening in the cover is formed by cutting out a part thereof, to allow a container to pass through the opening.

14. The refrigerator according to claim 13, wherein the cover further comprising hinge shafts at a lower portion thereof, to enable the cover to be pivotably coupled with the case; and a hooking unit at an upper portion thereof, to enable the cover to be coupled with and decoupled from the door whenever the user pushes the cover.

15. The refrigerator according to claim 14, wherein the hooking unit comprises hooks installed to the cover, and hooking recesses installed to the case to receive and separate the hooks.

16. The refrigerator according to claim 15, wherein the lever comprises:

hinge shafts to allow the lever to pivot backwards towards an interior of the refrigerator and to contact with the key unit when the user grasps the container; and elastic springs which are fitted around the hinge shafts to allow the lever to return to an original state when the user releases a force applied to the lever.

17. The refrigerator according to claim 16, wherein the lever further comprises a stepped stopper at an upper end thereof, to allow the lever to be pivoted only toward the extraction section.

18. The refrigerator according to claim 17, wherein when a user wants to extract water or ice using a container which is smaller than the opening, the user pushes the lever in a state in which the cover closes the extraction section, and the lever contacts with the key unit to allow water or ice to be extracted and contained in the container.

19. The refrigerator according to claim 17, wherein when a user wants to extract water or ice using a container which is larger than the opening of the cover, user pushes an upper portion of the cover to enable the hooks to be released from the hooking recesses and the cover is rotated to thereby open the extraction section, such that the user uses the container to contact with the key unit, to thereby extract water or ice into the container.

20. The refrigerator according to claim 19, wherein when the cover opens the extraction section, a rear surface of the cover is in a horizontal state, to enable the cover to be used as a support table on which the container is placed.

* * * * *